US008967131B2

(12) United States Patent
Hunt

(10) Patent No.: US 8,967,131 B2
(45) **Date of Patent: *Mar. 3, 2015**

(54) GATED FULL CAPTURE ARCHERY REST

(71) Applicant: Field Logic, Inc., Superior, WI (US)

(72) Inventor: Fred Hunt, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/891,381

(22) Filed: May 10, 2013

(65) Prior Publication Data

US 2013/0269668 A1 Oct. 17, 2013

Related U.S. Application Data

(63) Continuation-in-part of application No. 13/864,958, filed on Apr. 17, 2013.

(60) Provisional application No. 61/625,564, filed on Apr. 17, 2012.

(51) Int. Cl.
*F41B 5/22* (2006.01)
*F41B 5/14* (2006.01)

(52) U.S. Cl.
CPC ..... *F41B 5/143* (2013.01)
USPC ..... 124/44.5

(58) Field of Classification Search
CPC ..... F41B 5/143
USPC ..... 124/24.1, 44.5
See application file for complete search history.

(56) References Cited

U.S. PATENT DOCUMENTS

| | | | | |
|---|---|---|---|---|
| 4,351,311 | A * | 9/1982 | Phares | 124/44.5 |
| 5,042,450 | A * | 8/1991 | Jacobson | 124/44.5 |
| 5,253,633 | A * | 10/1993 | Sisko | 124/44.5 |
| 5,460,153 | A * | 10/1995 | Huntt | 124/44.5 |
| 5,526,800 | A * | 6/1996 | Christian | 124/44.5 |
| 6,561,175 | B1 * | 5/2003 | Tidmore | 124/44.5 |
| 6,772,747 | B1 * | 8/2004 | Vastag | 124/44.5 |
| 6,978,775 | B2 * | 12/2005 | Graf | 124/44.5 |
| 7,975,680 | B1 * | 7/2011 | Montgomery | 124/44.5 |

* cited by examiner

*Primary Examiner* — John Ricci
(74) *Attorney, Agent, or Firm* — Stoel Rives LLP

(57) ABSTRACT

An arrow rest for retaining an arrow in a shooting position on an archery bow. The arrow rest includes a structure surrounding a opening. The structure including a gap configured to pass the arrow into the opening. A gate is pivotally attached to the structure and biased to extend across the gap in a closed position. The structure completely surrounds the opening when the gate is in the closed position. A plurality of arrow supports are attached to the structure and extend radially into the opening toward the shooting position. At least one of the arrow supports is pivotally attached to the structure and biased toward the shooting position. The arrow support is biased to capture the arrow against the other arrow supports in the shooting position and to be displaced away from the shooting position when the arrow is launched from the archery bow.

20 Claims, 12 Drawing Sheets

GATED FULL CAPTURE ARCHERY REST

RELATED APPLICATIONS

The present application is a continuation-in-part of U.S. Ser. No. 13/864,958 entitled Gated Full Capture Archery Rest, filed Apr. 17, 2013, which claims the benefit of U.S. Provisional application Ser. No. 61/625,564, entitled Gated Full Capture Archery Rest, filed Apr. 17, 2012, both of which are hereby incorporated by reference.

FIELD OF THE INVENTION

The disclosure generally relates to archery equipment and more particularly to a gated arrow rest.

BACKGROUND

Arrow rests are well known in the art. An arrow rest provides support to the arrow while the bow is being carried, drawn, released, and during the initial flight of an arrow until it departs the bow. In order for a rest to be effective it must offer enough support to the arrow to enable the bow to be carried and drawn safely without the arrow falling from the rest. The rest must impart minimal friction to the arrow to prevent parasitic kinetic energy losses. An arrow rest must be durable enough to withstand thousands of shots and rough handling without changing the point of impact. Ideally, the arrow rest should have minimal contact with the fletching (feathers) on the arrow. Fletchings are an integral part of accurate arrow flight, and any contact to the fletchings can disrupt the arrow's flight, and rest induced damage to the fletchings can degrade the accuracy of the affected arrow.

U.S. Pat. No. 5,070,855 (Troncoso) discloses an archery rest that consists of two prongs that form a "U" shaped trough that is biased against the arrow by a spring. The arrow rests on the points of the two prongs. The arrow rest is sufficiently rigid and durable, imparts little friction to the arrow, and has minimal fletching contact, but does very little to prevent the arrow from falling off of the rest. With this style rest it is difficult for archers, especially beginners, to draw the bow without the arrow falling off of the rest.

U.S. Pat. No. 6,978,775 (Graf) discloses an arrow rest that consists of a plurality of radially disposed, inwardly projecting brush bristles. This style rest provides very good containment, but has a large amount of frictional losses and fletching contact. Additionally, the brush material is consumed during the shooting process, requiring frequent replacement of the brush material.

U.S. Pat. No. 6,994,080 (Yoder) discloses a similar variant of arrow rest to the Graf patent with the exception of rather than having a semi-continuous ring of inwardly projected, radially disposed bristles, there are three spaced apart arrow supports mounted to a ring at about 120 degree intervals. These supports consist of a support shoe and a plurality of bristles that extend inwardly from the support shoe for supporting the arrow. The support shoe and brush bristles are located at 60, 180 and 300 degrees as the rest mounted on the bow with the arrow located in the center of the ring. The arrow is loaded into the rest by placing the arrow in the slot in the top of the ring and pushing the arrow down between the brushes. This style rest decreases the frictional losses and fletching wear associated with the Graf patent, but still suffers from significant brush wear and difficulty loading of the arrow into the rest. Additionally, it is possible for the arrow to fall down between the lower brushes, or be expelled upward between the two upper brushes, completely out of the arrow rest.

SUMMARY OF THE INVENTION

The present disclosure is directed to an arrow rest for retaining an arrow in a shooting position on an archery bow. The arrow rest includes a structure surrounding an opening. The structure includes a gap configured to pass the arrow into the opening. A gate is pivotally attached to the structure and biased to extend across the gap so the structure completely surrounds the opening when the gate is in the closed position. A plurality of arrow supports are attached to the structure and extend radially into the opening toward the shooting position. At least one of the arrow supports is movably attached to the structure and is biased toward the shooting position. The movable arrow supports are biased to capture the arrow against the other arrow supports in the shooting position and to be displaced away from the shooting position when the arrow is launched from the archery bow.

In one embodiment, at least two of the arrow supports are pivotally attached to the structure and are biased toward the shooting position of the opening. The arrow supports are biased to capture the arrow in the shooting position.

In one embodiment, the gate displaces at least one of the arrow supports away from the shooting position when in an open position to facilitate positioning the arrow in the shooting position. The gate is in the closed position when the arrow is in the shooting position.

In one embodiment, at least one of the arrow supports pivots around an axis perpendicular to an axis of an arrow in the shooting position. In another embodiment, at least one of the arrow supports pivots around an axis parallel to an axis of an arrow in the shooting position. The arrow supports preferably pivot in a direction of travel of the arrow.

The arrow supports can be located at about 0 degrees, about 120 degrees and about 240 degrees relative to the structure. At least one of the arrow supports can be a rigid structure or a flexible structure that engages with the arrow in the shooting position. In another embodiment, all of the arrow supports are movable. The arrow supports preferably include a low friction surface that engages with the arrow in the shooting position.

An adjustable stop permits the minimum separation between the arrow supports to be adjusted. The adjustable stop permits the user to adjust the holding force applied to the arrow in the shooting position.

The present disclosure is also directed to a method of retaining an arrow in a shooting position on an archery bow. The method includes displacing a gate on a structure to pass an arrow through a gap and into an opening of an arrow rest. At least one arrow support located in the opening is displaced to position the arrow in the shooting position. The at least one displaced arrow support is biased to capture the arrow against the other arrow supports to secure the arrow in the shooting position. The gate is biased to a closed position extending across the gap so the structure completely surrounds the opening when the arrow is in the shooting position.

The method includes displacing at least one of the arrow supports away from the shooting position when the arrow is launched from the bow. In one embodiment, the gate displaces at least one of the arrow supports away from the shooting position when in an open position to facilitate positioning the arrow in the shooting position.

In one embodiment, the arrow supports pivot around an axis perpendicular or parallel to an axis of an arrow when launched. The arrow supports preferably pivot in a direction of travel of the arrow.

The method includes adjusting a stop to adjust a minimum separation between the arrow supports. The method also includes adjusting a stop configured to adjust a holding force applied to the arrow in the shooting position.

In one embodiment, two of the arrow supports are spring loaded on threaded pins that are parallel with the loaded arrow. The supports are biased upwards toward the arrow with torsion springs. During loading or on the shot, the torsion springs are overpowered such that the arrow supports rotate about the threaded pin, downward towards the bottom of the ring approximately 15 degrees.

An advantage of the present disclosure is that it allows for diminished frictional losses imparted to the arrow due to the low friction, spring loaded supports.

Another advantage of the present disclosure is that it offers improved accuracy due to the lack of fletching contact with the brushes.

Yet another advantage of the present disclosure is that it reduces the wear associated with brushes supporting the bottom of an arrow during the shot. This feature reduces the inaccuracies associated with the degradation of the brush material.

Yet another advantage of the present disclosure is that the gate prevents the arrow from leaving the rest should the arrow be bumped while an arrow is loaded.

Yet another advantage of the current disclosure is that the gate assists in the loading if the arrow by displacing the lower support. This feature reduces the effort required to load the arrow and reduces the noise resulting from loading the arrow. The gate assisted loading also allows for the supports to be disposed in a much tighter arrangement, greatly reducing the chance for the arrow to fall off of the supports while the bow is being drawn and shot.

BRIEF DESCRIPTION OF THE DRAWINGS

The accompanying drawing, which constitutes part of the specification, helps to illustrate embodiments of the disclosure.

DESCRIPTION OF THE PREFERRED EMBODIMENT

Figure 1:
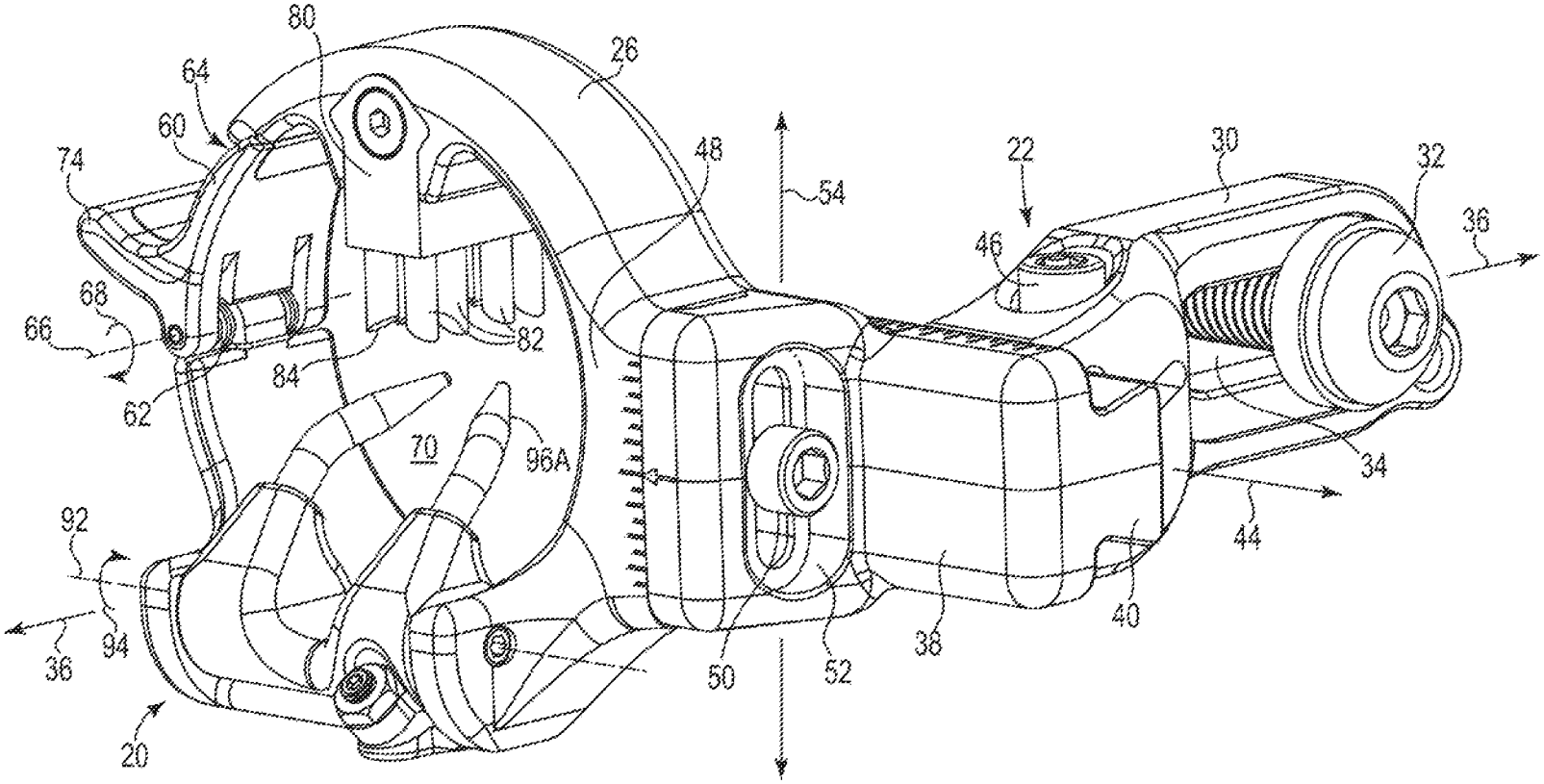
FIG. 1 is an isometric view of an arrow rest assembly according to an embodiment of the disclosure.
Figure 2:
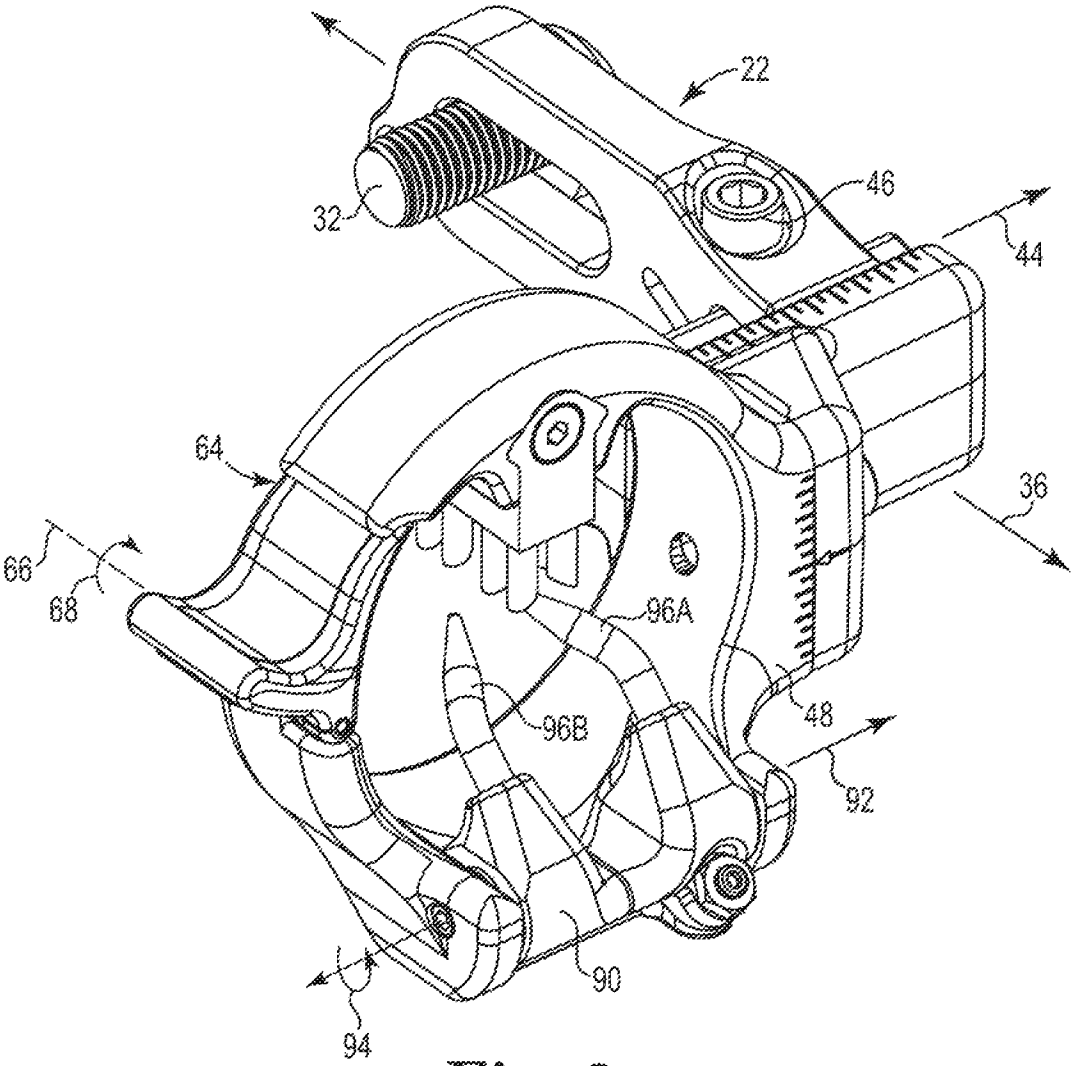
FIG. 2 is an isometric view of the arrow rest of FIG. 1.
Figure 3:
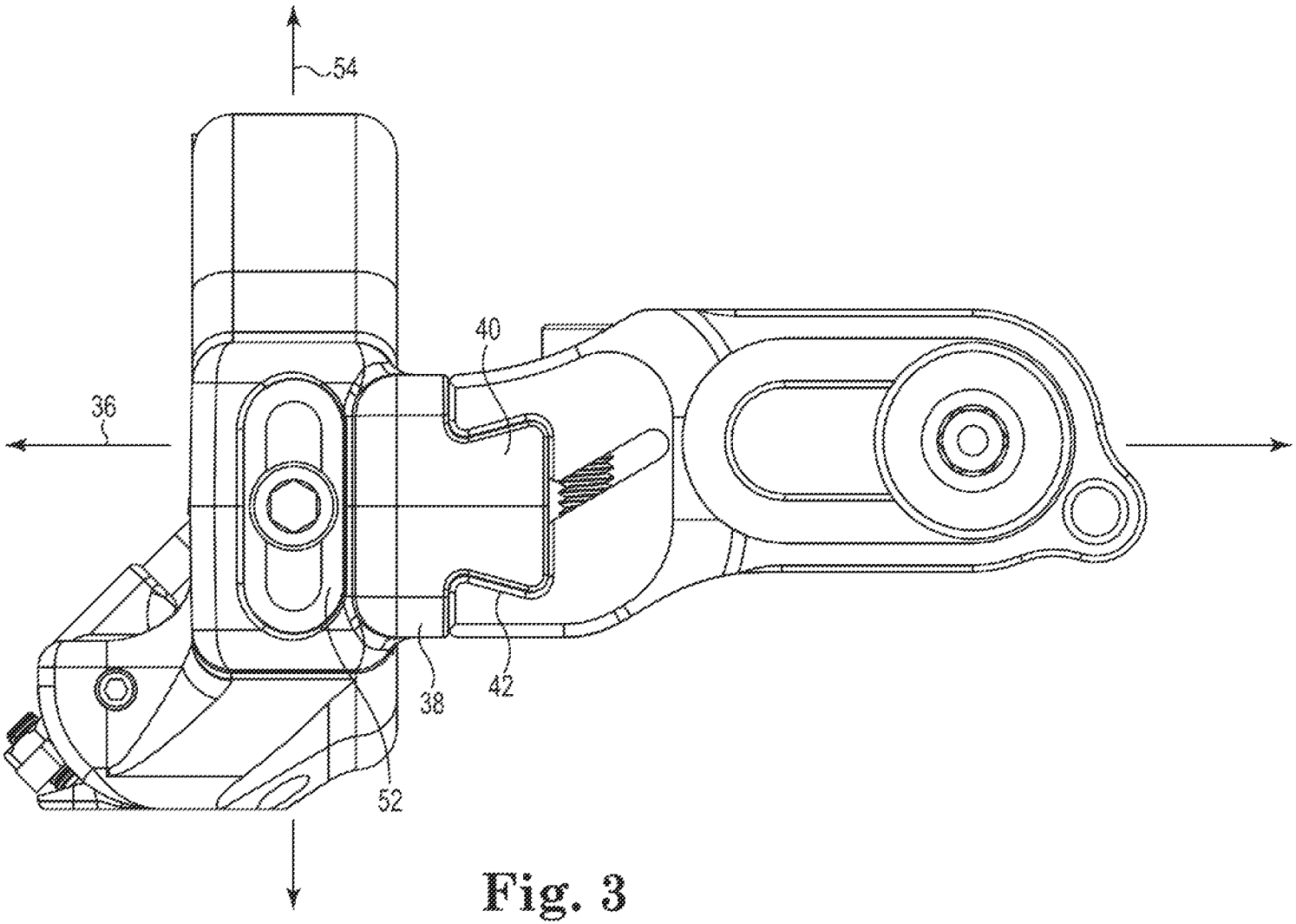
FIG. 3 is a side view of the arrow rest of FIG. 1.
Figure 4:
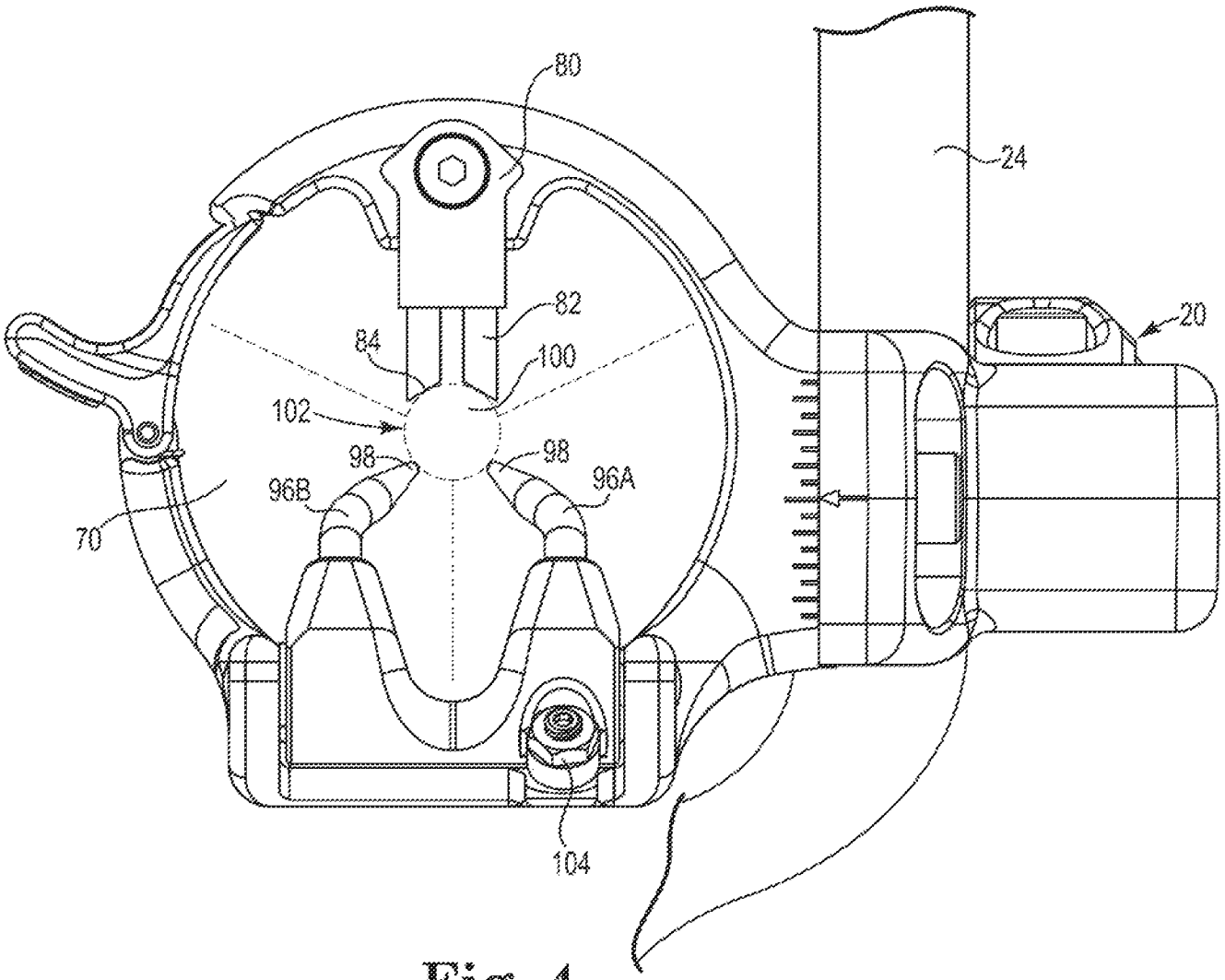
FIG. 4 is a front view of the arrow rest of FIG. 1 with an arrow loaded in the shooting position in accordance with an embodiment of the present disclosure.

FIGS. 1 through 5 are various views of an arrow rest 20 in accordance with an embodiment of the present disclosure. Mounting bracket 22 attaches the arrow rest 20 to a riser 24 of a bow, as illustrated in FIG. 4. In the illustrated embodiment, the mounting bracket 22 permits adjustment of ring 26 relative to the riser 24 (see FIG. 4) in at least three degrees of freedom, selected from x-axis, y-axis, z-axis, pitch, roll and yaw. A variety of mounting brackets are known for this purpose.

Portion 30 of the mounting bracket 22 is attached to the riser 24 using fastener 32. Elongated slot 34 in the portion 30 permits adjustment along z-axis 36. Portion 38 of the mounting bracket 22 includes dovetail feature 40 that slides in a complementary channel 42 (see FIG. 3) on the portion 30 to provide adjustment along x-axis 44. Fastener 46 is used to secure the portion 38 relative to the portion 30. Portion 48 is attached to the portion 38 using fastener 50. Elongated slot 52 permits adjustment along the y-axis 54.

Ring 26 includes gate 60 that is biased to closed position by spring 62 to extend across gap 64 (see FIG. 7) to completely surround the opening 70 to secure the arrow 100. The gap 64 is typically located between about 270-315 degrees on the ring 26 for right handed shooters and about 45-90 degrees for left-handed shooters. The gate 60 pivots around axis 66 in direction 68 into opening 70 to permit an arrow 72 to be loaded (see FIGS. 4 and 5). When the gate 60 is in the closed position, the opening 70 is completely surrounded by the ring 26. Flange 74 on the gate 60 can be used to locate an arrow to be loaded in the arrow rest 20, as discussed herein.

Support assembly 80 is mounted to the ring 26 and includes supports 82 that extend radially into the opening 70. In the illustrated embodiment, the supports 82 are discrete bundles of bristles with beveled tips 84 corresponding generally to the radius of curvature of an arrow (see FIG. 4).

Pivoting support assembly 90 is pivotally attached to the ring 26 and rotates around axis 92 in direction 94. The axis 92 is generally perpendicular to an axis of the arrow 100 when in the shooting position. A pair of movable supports 96A, 96B ("96") are attached to the pivoting support assembly 90 to extend into the opening 70. In an alternate embodiment, the movable supports 96A, 96B pivot independently around the axis 92. The movable supports 96 can be constructed from a variety of rigid or semi-rigid materials such as metal or polymeric materials.

It will be appreciated that the number and configuration of the arrow supports can vary with the fletching configuration of the arrow, so long as the arrow 100 is secured in the shooting position. In one embodiment, at least one of the arrow supports pivotally attaches to the structure and is biased toward the shooting position. In another embodiment, all of the supports are movable. In the illustrated embodiment, the elastic deformation of the bristles 82 provides the displacement. As used herein, "movable" includes displacement and/or deformation of an arrow support.

Figure 5:
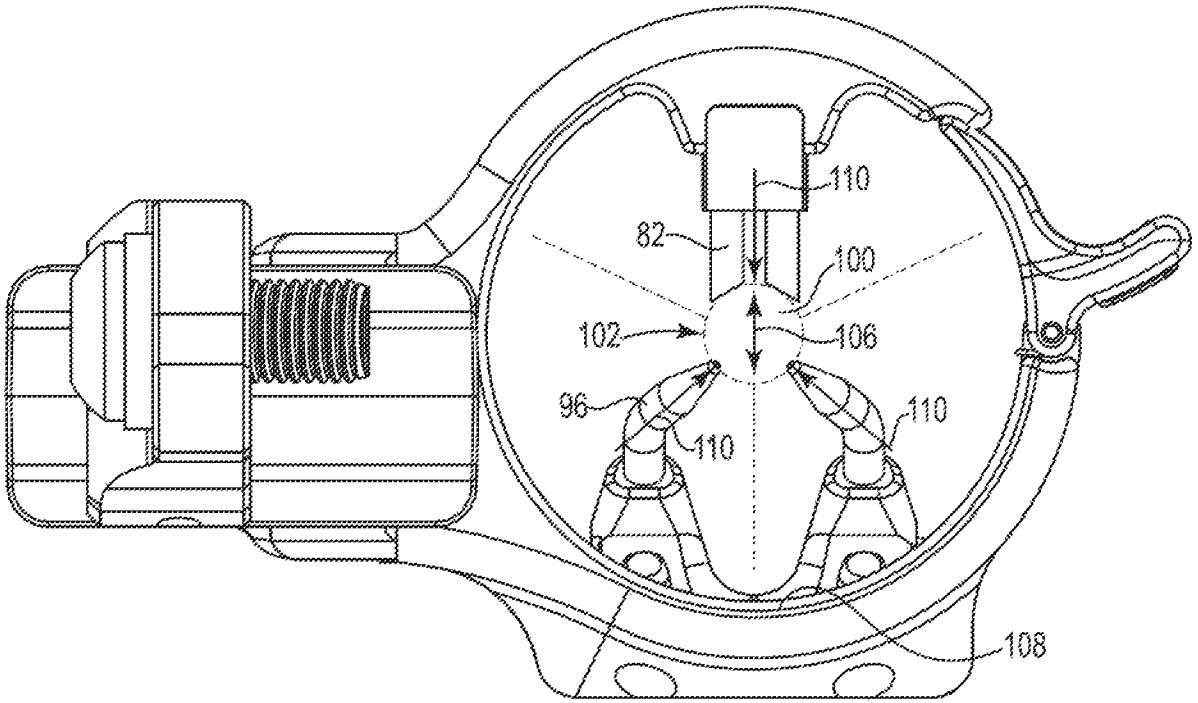
FIG. 5 is a rear view of the arrow rest of FIG. 1 with an arrow loaded in the shooting position.

As best illustrated in FIGS. 4 and 5, tips 98 of the movable supports 96 cooperate with the supports 82 to capture an arrow 100 in a shooting position 102. The pivoting support assembly 90 is biased toward the shooting position 102. When the arrow 100 is launched, the pivoting support assembly 90 rotates in direction 94 to minimize the contact between the arrow 100 and the arrow rest 20. In particular, the movable supports 96 rotate in a direction of travel of the arrow. While the pivoting support assembly 90 can theoretically rotate in direction 94 until it contacts lower inside surface 108 of the ring 26, in actual use the pivoting support assembly 90 typically rotates about 5 degrees to about 10 degrees.

Stop 104 permits adjustment of a minimum separation between the supports 82 and the movable supports 96 to correspond to the diameter 106 of the arrow 100.

The stop 104 also permits adjustment to the holding force 110 applied to the arrow 100 in the shooting position 102. For example, by reducing the minimum separation between the supports 82, 96, the holding force 110 on the arrow 100 is increased. Similarly, by increasing the minimum separation, the holding force 100 is decreased. The stop 104 permits the user to minimizing the holding force 110 on the arrow 100 to reduce drag during launch, while still securely retaining the arrow 100 in the arrow rest 20.

Figure 6:
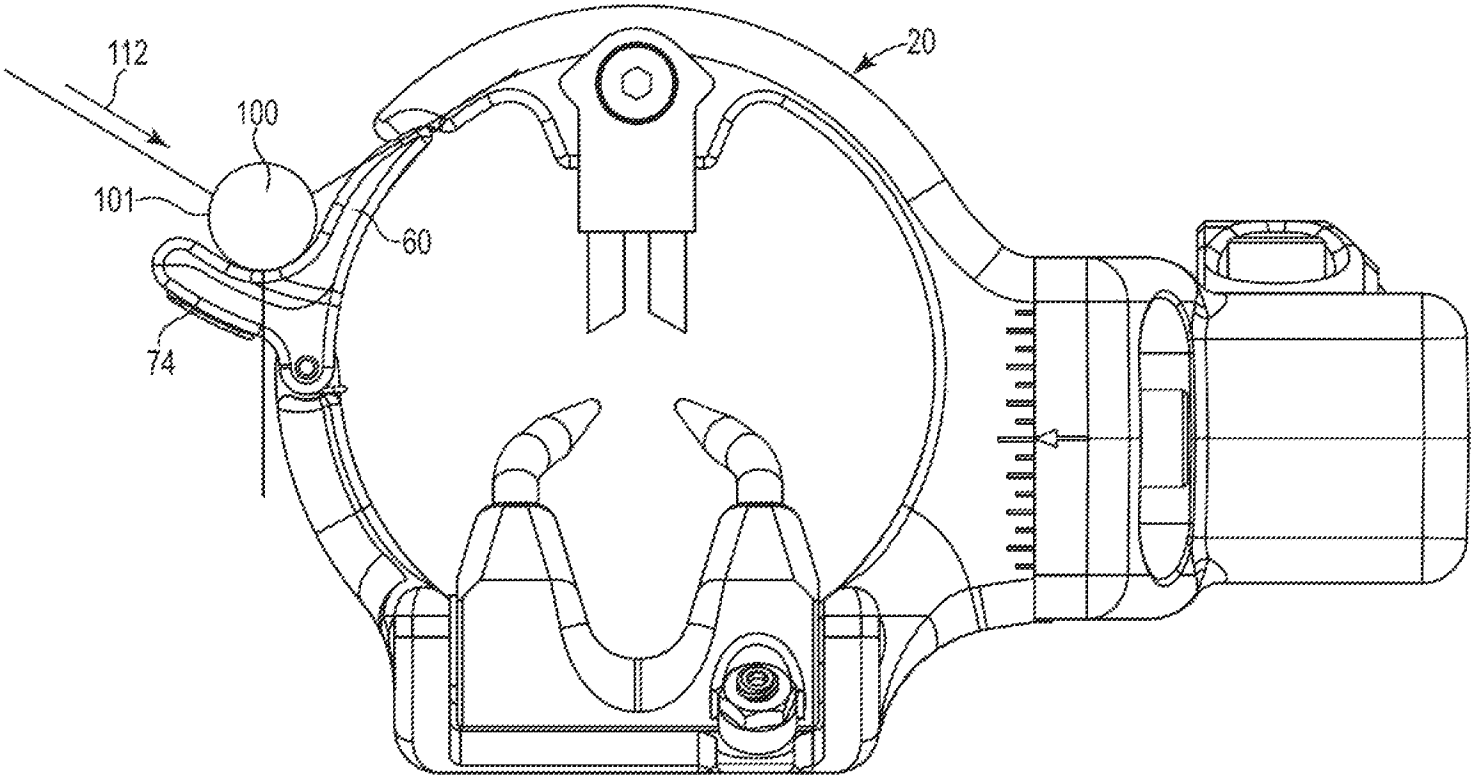
FIG. 6 illustrates a method of loading an arrow into the arrow rest of FIG. 1 in accordance with an embodiment of the present disclosure.
Figure 7:
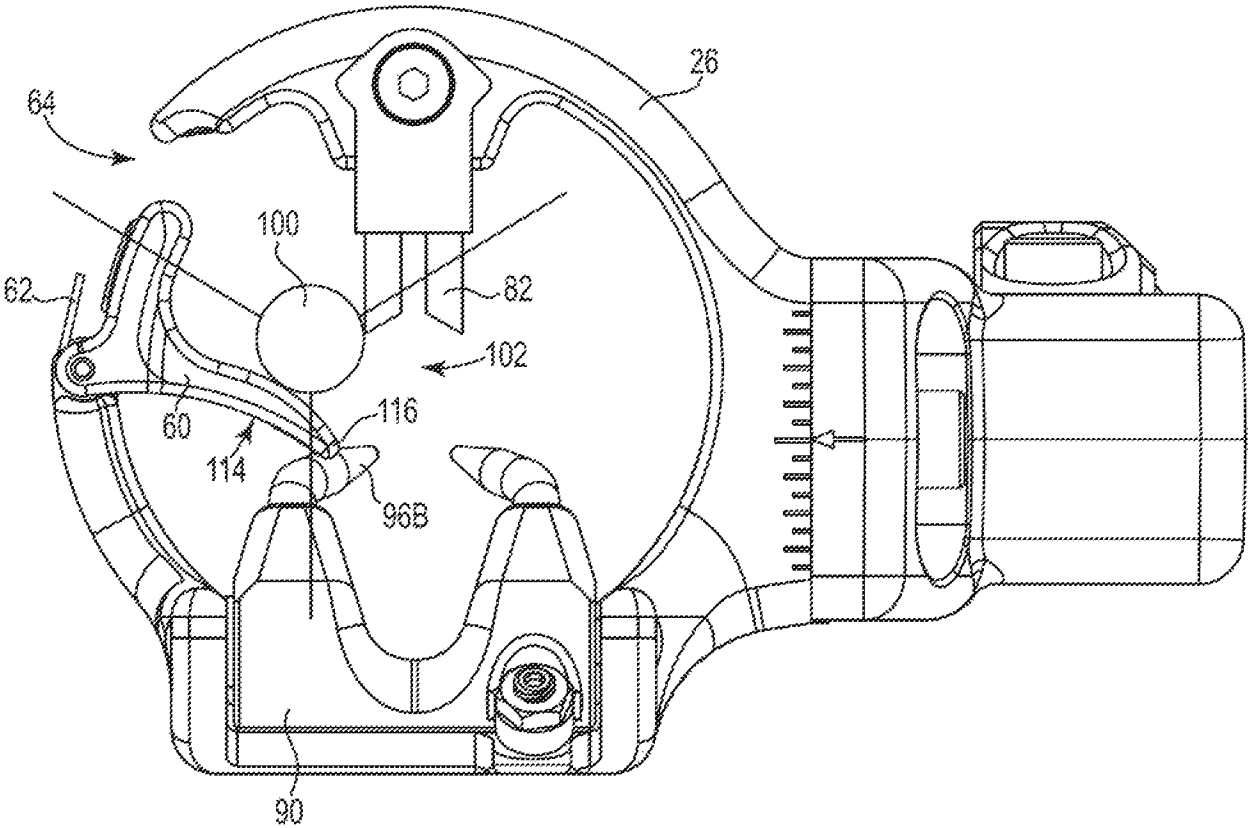
FIG. 7 illustrates the arrow of FIG. 6 partially loaded in the arrow rest.
Figure 8:
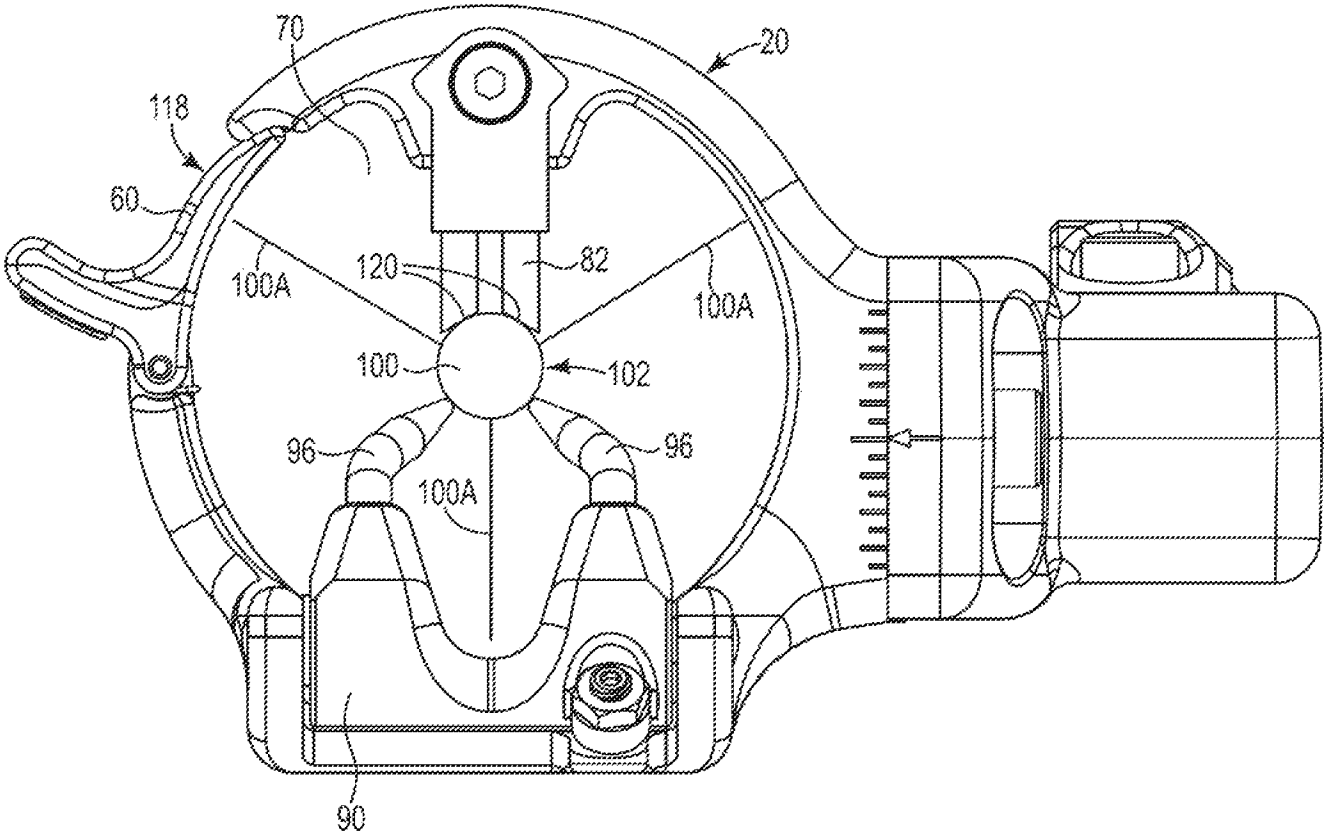
FIG. 8 illustrates the arrow of FIG. 7 fully loaded in the arrow rest.

FIGS. 6 through 8 illustrate the process of loading arrow 100 in the arrow rest 20 in accordance with an embodiment of the present disclosure. The shaft 101 of the arrow 100 is press against the gate 60. Flange 74 on the gate 60 positions the arrow 100 in the optimum loading position.

Force 112 overcomes the biasing force of the gate spring 62 and pushes the gate 60 to the open position 114 illustrated in FIG. 7. Distal end 116 of the gate 60 contacts the movable support 96B and causes the pivoting support assembly 90 to rotate in the direction 94 toward the lower inside surface 108 of the ring 26. In an embodiment in which the support 82 is rigid, the pivoting support assembly 90 rotates in the direction 94 until the arrow 100 can be positioned in the shooting position 102. In an embodiment in which the support 82 is flexible, the support 82 optionally deforms to permit the arrow 100 to be positioned in the shooting position 102.

FIG. 8 illustrates the arrow 100 in the shooting position 102 of the opening 70. With the gate 60 rotated to closed position 118, the opening 70 is completely surrounded by the ring 26. The arrow 100 is now prevented from falling laterally out of the arrow rest 20. The pivoting support assembly 90 rotates the movable supports 96 into engagement with the arrow 100. In the illustrated embodiment, the support 82 contacts the arrow 100 in two locations 120.

The supports 82, 96 are preferably located at about 0, 120, and 240 degrees relative to the ring 26. In light of the three-point capture system provided by the supports 82, 96, however, the particular location for the supports 82, 96 is not critical. For example, the supports 82, 96 could be located at about 90, 210, 330 degrees.

The optimum separation of the supports 82, 96, however, is dependent on the locations of the arrow fletchings 100A. For a three fletching arrow, the supports 82, 96 are preferably located at about 120 degree intervals. In the illustrated embodiment, the arrow fletchings 100A are located at about 45, 180 and 315 degrees, so there is minimal contact with the supports 82, 96.

Figure 9:
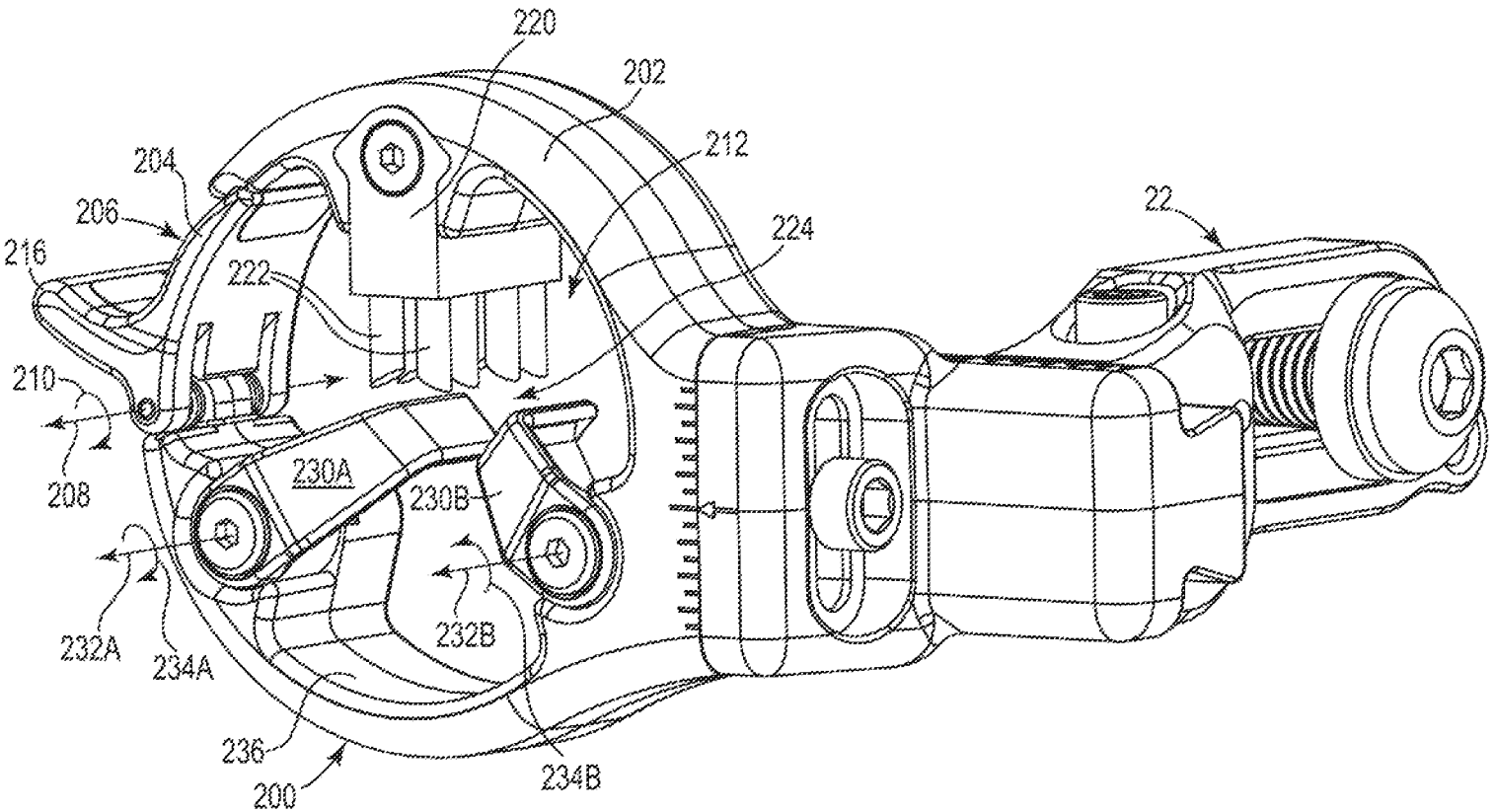
FIG. 9 is an isometric view of an alternate arrow rest assembly according to an embodiment of the disclosure.
Figure 10:
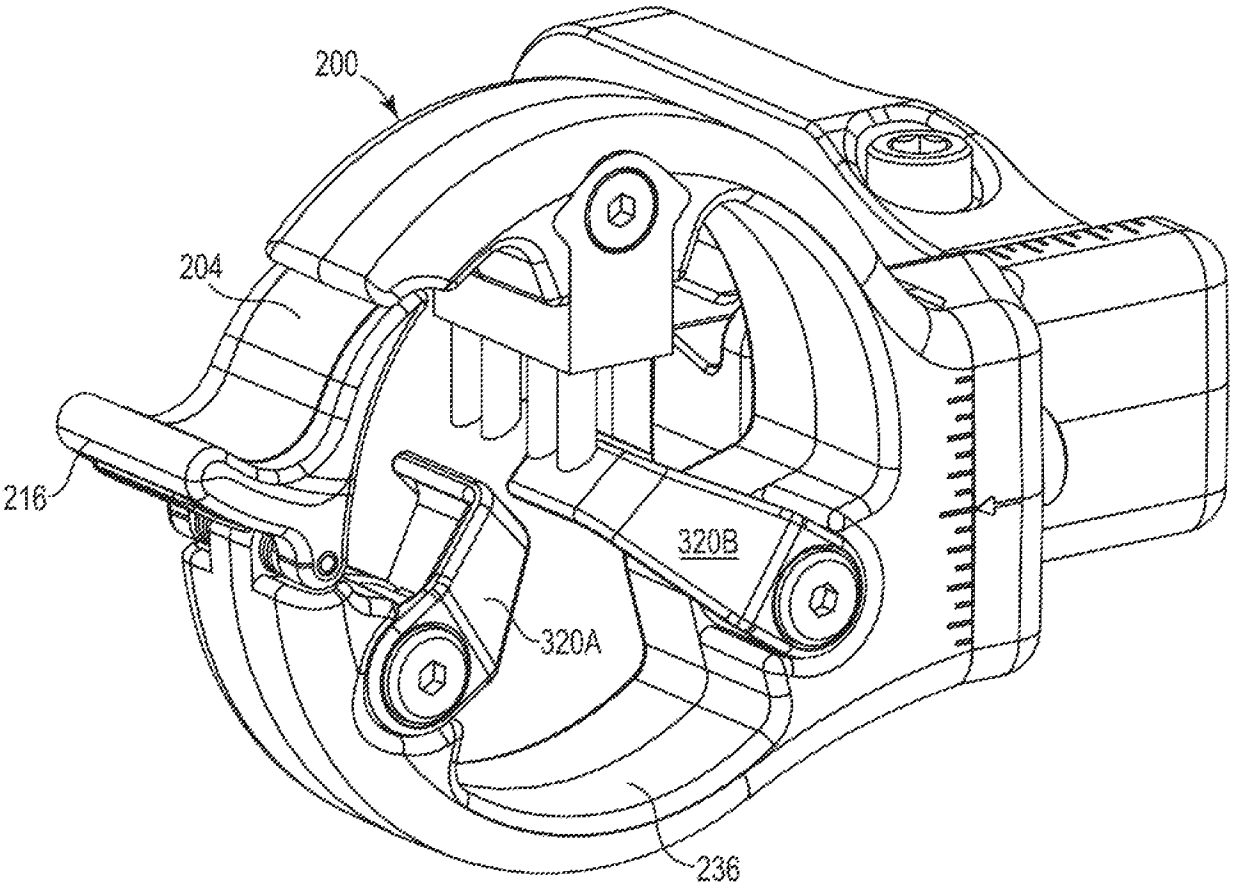
FIG. 10 is an isometric view of the arrow rest of FIG. 9.
Figure 11:
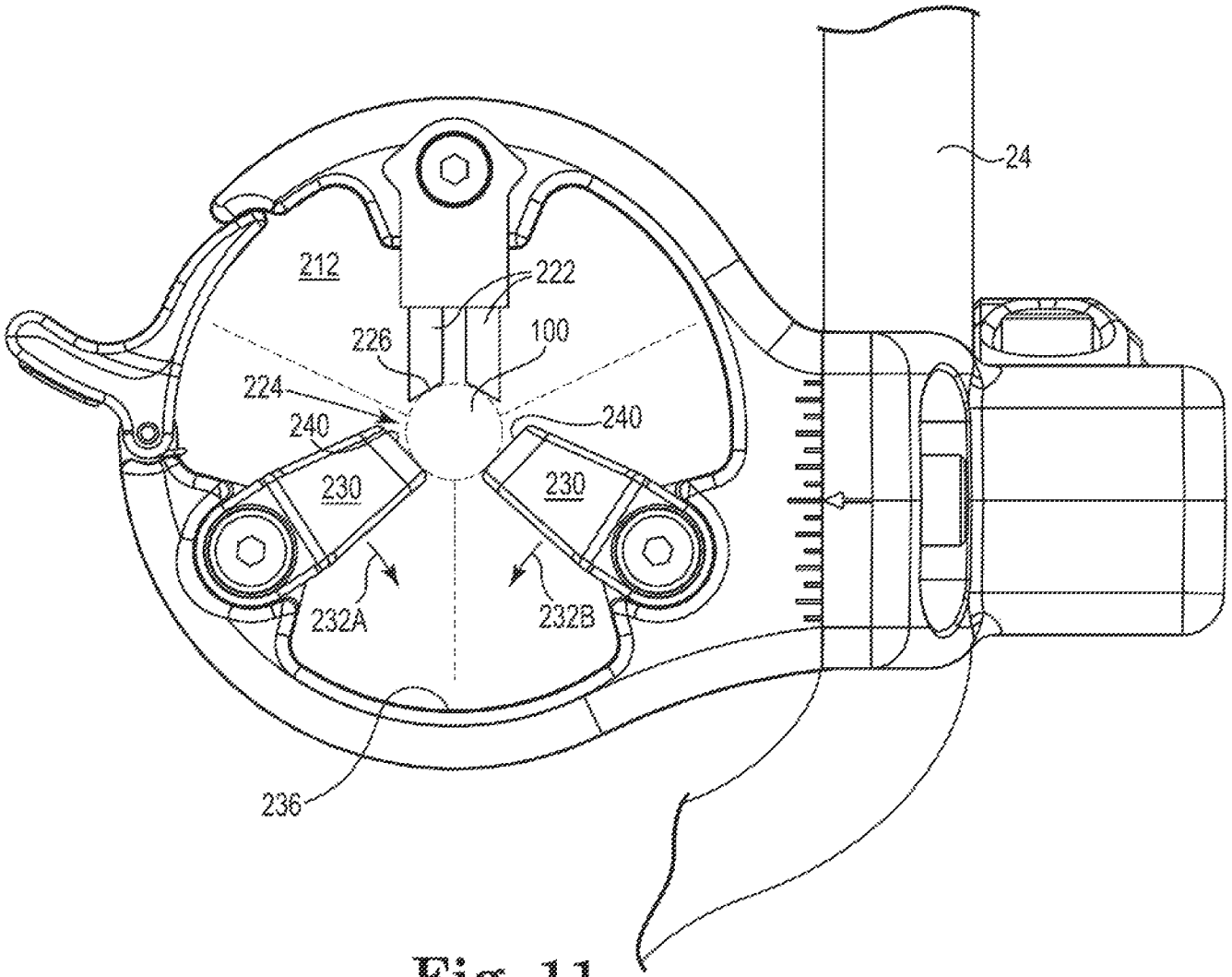
FIG. 11 is a front view of the arrow rest of FIG. 9 with an arrow loaded in the shooting position in accordance with an embodiment of the present disclosure.

FIGS. 9 through 10 are perspective views of an alternate arrow rest 200 in accordance with an embodiment of the present disclosure. Mounting bracket 22 attaches the arrow rest 200 to a riser 24 of a bow, as illustrated in FIG. 11. Details of the mounting bracket 22 are discussed in connection with FIGS. 1 and 2.

Ring 202 includes gate 204 that is biased to closed position 206. The gate 204 pivots around axis 208 in direction 210 into opening 212 to permit an arrow 100 to be loaded into shooting position 224 (see FIGS. 11 and 12). Flange 216 on the gate 204 can be used to locate the arrow 100 to be loaded in the arrow rest 200, as discussed herein.

Support assembly 220 is mounted to the ring 202 and includes supports 222 that extend radially into the opening 224. In the illustrated embodiment, the supports 222 are discrete bundles of bristles with beveled tips 226 corresponding generally to the radius of curvature of the arrow 100.

Movable supports 230A, 230B ("230") are pivotally attached to the ring 202 and rotates around axis 232A, 232B ("232") in directions 234A, 234B ("234"), respectively. The axes 232 are generally parallel to an axis of the arrow 100 when in the shooting position 224. The movable supports 230 are biased toward the support assembly 220, but can independently pivot around the axes 232 toward the lower inside surface 236 of the ring 202. The movable supports 230 can be constructed from a variety of rigid or semi-rigid materials such as metal or polymeric materials.

Figure 12:
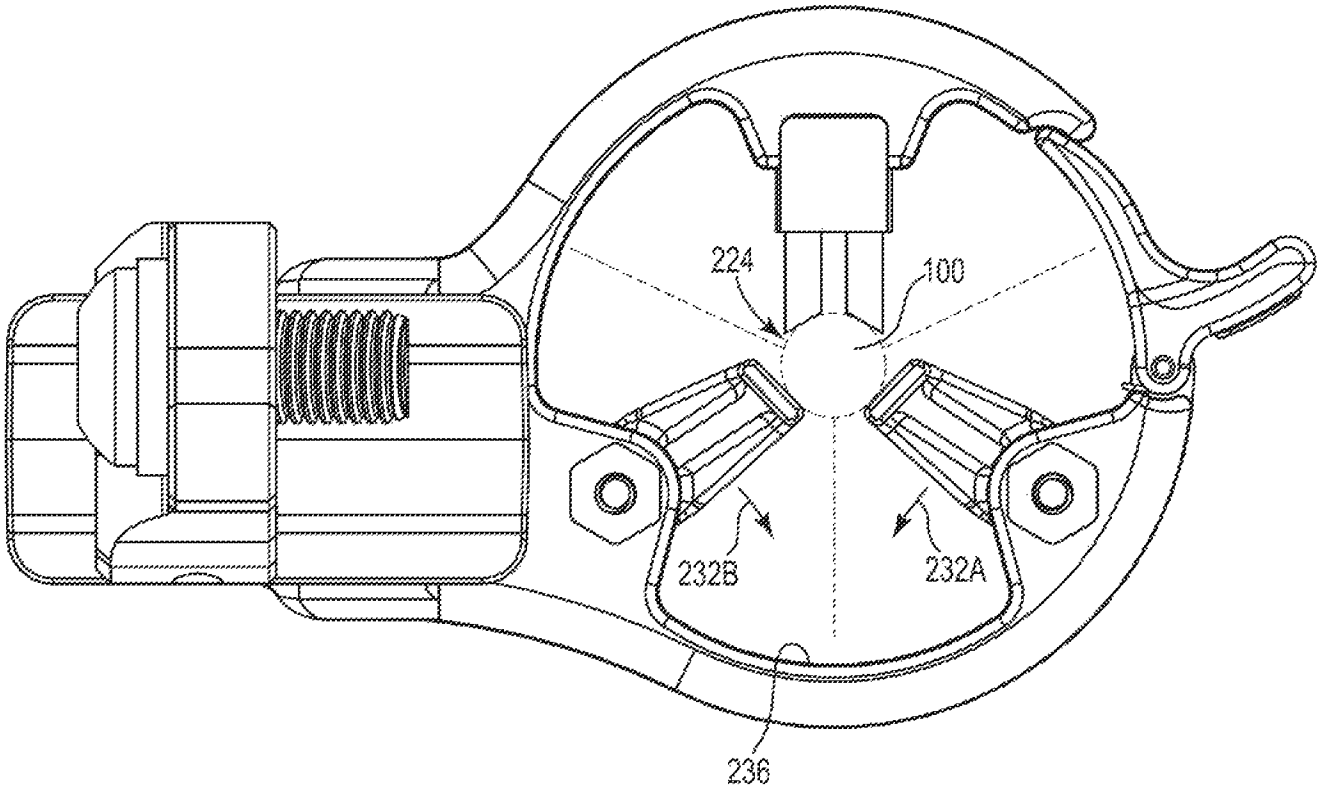
FIG. 12 is a rear view of the arrow rest of FIG. 9 with an arrow loaded in the shooting position.

As best illustrated in FIGS. 11 and 12, contact surfaces 240 of the movable supports 230 cooperate with the supports 222 to capture an arrow 100 in a shooting position 224. The movable supports 230 are biased toward the shooting position 224.

When the arrow 100 is launched, the biasing forces, typically from torsion springs, are overpowered and the movable supports 230 rotate in directions 232A, 232B toward the lower inside surface 236 of the ring 202. The rotation of the supports 230 minimizes the contact between the arrow 100 and the contact surfaces 240 during arrow launch. While the movable supports 230 can theoretically rotate in directions 232A, 232B until they contacts lower inside surface 236 of the ring 202, in actual use the movable supports 230 typically rotates about 5 degrees to about 10 degrees.

Where a range of values is provided, it is understood that each intervening value, to the tenth of the unit of the lower limit unless the context clearly dictates otherwise, between the upper and lower limit of that range and any other stated or intervening value in that stated range is encompassed within the embodiments of the disclosure. The upper and lower limits of these smaller ranges which may independently be included in the smaller ranges is also encompassed within the embodiments of the disclosure, subject to any specifically excluded limit in the stated range. Where the stated range includes one or both of the limits, ranges excluding either both of those included limits are also included in the embodiments of the present disclosure.

Unless defined otherwise, all technical and scientific terms used herein have the same meaning as commonly understood by one of ordinary skill in the art to which the embodiments of the present disclosure belong. Although any methods and materials similar or equivalent to those described herein can also be used in the practice or testing of the embodiments of the present disclosure, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments of the disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of the present disclosure. It should be understood that various features and aspects of the disclosed embodiments can be combined with or substituted for one another in order to form varying modes of the disclosed embodiments of the disclosure. Thus, it is intended that the scope of the present disclosure herein disclosed should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment(s) that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. An arrow rest for retaining an arrow in a shooting position on an archery bow, the arrow rest comprising:

a structure surrounding an opening, the structure including a gap configured to pass the arrow into the opening;

a gate pivotally attached to the structure and biased to extend across the gap in a closed position, wherein the structure completely surrounds the opening when the gate is in the closed position; and a plurality of arrow support attached to the structure and extending generally radially into the opening toward the shooting position, at least one of the arrow support movable relative to the structure and is biased to capture the arrow against the other arrow supports in the shooting position, wherein the at least one arrow support is displaced away from the shooting position when the arrow is launched from the archery bow, wherein the gate displaces at least one of the arrow supports away from the shooting position when in an open position to facilitate positioning the arrow in the shooting position.

2. The arrow rest of claim 1 wherein the gate is in the closed position when the arrow is in the shooting position.

3. The arrow rest of claim 1 wherein at least one of the arrow support pivots around an axis generally perpendicular to an axis of the arrow when in the shooting position.

4. The arrow rest of claim 1 wherein at least one of the arrow support pivots around an axis generally parallel to an axis of the arrow when in the shooting position.

5. The arrow rest of claim 1 wherein at least one of the arrow support pivots in a direction of travel of the arrow during launch of the arrow.

6. The arrow rest of claim 1 wherein the arrow supports are located at about 0 degrees, about 120 degrees and about 240 degrees relative to the structure.

7. The arrow rest of claim 1 wherein at least one of the arrow supports comprises a rigid structure or a flexible structure that engages with the arrow in the shooting position.

8. The arrow rest of claim 1 wherein the arrow supports include a low friction surface that engages with the arrow in the shooting position.

9. The arrow rest of claim 1 comprising an adjustable stop configured to adjust a minimum separation between the arrow supports when in the shooting position.

10. The arrow rest of claim 1 comprising an adjustable stop configured to adjust a holding force applied to the arrow in the shooting position.

11. An arrow rest for retaining an arrow in a shooting position on an archery bow, the arrow rest comprising:

a structure surrounding an opening, the structure including a gap configured to pass the arrow into the opening;

a gate pivotally attached to the structure and biased to extend across the gap in a closed position, wherein the structure completely surrounds the opening when the gate is in the closed position;

at least one fixed arrow support attached to the structure and extending into the opening toward the shooting position; and at least two arrow supports pivotally attached to the structure and biased toward the shooting position of the opening, wherein the pivotally attached arrow supports are biased to capture the arrow against the fixed arrow support in the shooting position and to rotate away from the shooting position when the arrow is launched from the archery bow, wherein the gate displaces at least one of the pivotally attached arrow supports away from the shooting position when in an open position.

12. A method of retaining an arrow in a shooting position on an archery bow comprising the steps of:

displacing a gate on a structure to pass an arrow through a gap into a opening of an arrow rest;

engaging the gate with at least one arrow support located in the opening to displace the at least one arrow support away from the shooting position;

biasing the at least one of the arrow supports to capture the arrow against the other arrow supports to secure the arrow in the shooting position; and biasing the gate to a closed position extending across the gap so the structure completely surrounds the opening.

13. The method of claim 12 comprising rotating around an axis at least one of the arrow supports away from the shooting position when the arrow is launched from the bow.

14. The method of claim 12 comprising displacing at least one of the arrow supports around an axis perpendicular to an axis of an arrow in the shooting position.

15. The method of claim 12 comprising displacing at least one of the arrow supports around an axis parallel to an axis of the arrow when in the shooting position.

16. The method of claim 12 comprising pivoting the arrow supports in a direction of travel of the arrow during arrow launch.

17. The method of claim 12 comprising adjusting a stop to adjust a minimum separation between the arrow supports.

18. The method of claim 12 comprising adjusting a stop configured to adjust a holding force applied to the arrow in the shooting position.

19. An arrow rest for retaining an arrow in a shooting position on an archery bow, the arrow rest comprising:

a structure surrounding an opening, the structure including a gap configured to pass the arrow into the opening;

a gate pivotally attached to the structure and biased to extend across the gap in a closed position, wherein the structure completely surrounds the opening when the gate is in the closed position;

first, second, and third arrow supports attached to the structure and extending generally into the opening toward the shooting position, the second and third arrow supports rotating around a common axis relative to the structure and are biased to capture the arrow against the first arrow support in the shooting position, wherein the second and third arrow supports are displaced away from the shooting position when the arrow is launched from the archery bow.

20. An arrow rest for retaining an arrow in a shooting position on an archery bow, the arrow rest comprising:

a structure surrounding an opening, the structure including a gap configured to pass the arrow into the opening;

a plurality of arrow support attached to the structure and extending generally radially into the opening toward the shooting position, at least one of the arrow supports is movable relative to the structure and biased against the arrow when in the shooting position, wherein the at least one arrow support is displaced away from the shooting position when the arrow is launched from the archery bow; and a gate pivotally attached to the structure and biased to extend across the gap in a closed position, wherein the structure and the gate completely surround the opening when the gate is in the closed position, and wherein the gate displaces at least one of the arrow supports away from the shooting position when in an open position to facilitate positioning the arrow in the shooting position.

* * * * *